United States Patent [19]

Mueller et al.

[11] Patent Number: 4,779,548

[45] Date of Patent: Oct. 25, 1988

[54] INCINERATION APPARATUS WITH IMPROVED WALL CONFIGURATION

[75] Inventors: James H. Mueller, Morristown; Rodney L. Pennington, Morris Township, Morris County, both of N.J.

[73] Assignee: Regenerative Environmental Equipment Company, Inc., Morris Plains, N.J.

[21] Appl. No.: 84,382

[22] Filed: Aug. 11, 1987

[51] Int. Cl.[4] ..... F23M 5/00

[52] U.S. Cl. ..... 110/336; 110/211; 110/333

[58] Field of Search ..... 110/203, 210, 211, 212, 110/331, 332, 333, 334, 335, 336, 338, 339; 431/5; 422/168, 169, 173, 175, 176, 178

[56] References Cited

U.S. PATENT DOCUMENTS

| | | | |
|---|---|---|---|
| 907,682 | 12/1908 | Cotton . | |
| 1,971,693 | 8/1934 | Neff | 110/338 |
| 2,869,488 | 1/1959 | Posey | 110/335 |
| 3,362,698 | 1/1968 | Cerny et al. . | |
| 3,634,026 | 1/1972 | Kuechler et al. . | |
| 3,895,918 | 7/1975 | Mueller . | |
| 4,248,841 | 2/1961 | Benedick | 110/204 X |
| 4,252,070 | 2/1981 | Benedick | 110/211 |
| 4,263,259 | 4/1981 | Benedick | 110/173 R X |
| 4,267,152 | 5/1981 | Benedick . | |
| 4,302,426 | 11/1981 | Benedick | 110/212 X |
| 4,426,360 | 1/1984 | Benedick | 110/212 X |
| 4,474,118 | 10/1984 | Benedick | 110/211 |
| 4,697,531 | 10/1987 | Benedick | 110/211 X |

*Primary Examiner*—Steven E. Warner
*Attorney, Agent, or Firm*—Paul & Paul

[57] ABSTRACT

An incineration apparatus is provided, preferably of the thermal heat regeneration type, in which noxious or other gases are passed to an incineration chamber, to be burnt at a sufficiently high temperature that they are disposed of, and in doing so, pass through heat-exchange beds of elements such as stones or the like, whereby the direction of gas flow may optionally be reversed. The stoneware beds reside in recovery chambers adjacent but contiguous with the combustion chamber, separated therefrom by built-up refractory blockwalls. The walls are of arcuate configuration and support the heat-retention elements in the recovery chambers. The walls are generally the thickness of a single refractory block, and are of a radius that is less than any radius of the combustion chamber and are of a sufficient radius such that the forces of the stone or other heat-retention elements outside the walls may be resisted to prevent wall collapse. With this wall configuration, the combustion chamber may be of any size, however massive, and yet the walls between the combustion chamber and recovery chambers are of a sufficient arcuate configuration to provide support for the stoneware. In accordance with this invention, the walls of the combustion chamber may even be generally linear, if desired.

16 Claims, 3 Drawing Sheets

INCINERATION APPARATUS WITH IMPROVED WALL CONFIGURATION

BACKGROUND OF THE INVENTION

In prior art devices of the energy regeneration type, it has been known to bring contaminated fumes or odors into a combustion chamber for burning the same at a sufficiently high temperature that substantially all that is released to the atmosphere is carbon dioxide and water.

It has also been known, that, in passage of such gases into a combustion chamber, they can pass preliminary through stoneware beds on their way to the combustion chamber, which stoneware beds have been pre-heated, so that they, in turn, can preheat the incoming gases so that combustion is assured as soon as the incoming gases pass into the combustion chamber. Sometimes, such gases, if they contain volatile organic compounds, can auto-ignite while still in the presence of the stoneware in the stoneware chambers. Generally, however, the principal combustion takes place in the combustion chamber. Periodically, the flow of gases is reversed, such that gases from the combustion chamber pass outwardly through the stoneware chamber, to pre-heat the same, as the products of combustion pass outwardly on their way to atmosphere. Generally such combustion processes alternate the flow through the recovery chambers having stoneware therein, such that the stoneware alternately pre-heats the incoming gases containing the undesired volatile organic compounds, or is itself heated by outgoing gases passing from the combustion chamber to atmosphere. This alternation occurs on a regular basis.

An example of such a system is that that is disclosed in U.S. Pat. No. 3,895,918 issued to James H. Mueller on July 22, 1975, the complete disclosure of which is herein incorporated by reference.

It is also known to construct the combustion chamber wall that separates the combustion chamber from the recovery chambers that hold the elements, into an arcuate, or preferably circular configuration, such that the pile of elements in each recovery chamber exerts its weight or gravity forces against the convex side of a built-up block wall, such that the number of blocks that comprise the wall remain in sufficient compression that they can resist the weight of the pile of stones in the recovery chamber. Such features are disclosed in copending U.S. Pat. No. 4,697,531 granted Oct. 6, 1987 on application Ser. No. 874,876, filed June 16, 1986 now U.S. Pat. No. 4,697,531 in the name of Edward H. Benedict, the complete disclosure of which is also herein incorporated by reference.

SUMMARY OF THE INVENTION

The present invention is directed to an improvement in a heat exchange apparatus, most particularly, in an incineration apparatus for gaseous fumes or the like, and most preferably of the types described above, but in which there is provided the facility for making the combustion chamber larger and larger, even unlimited in circular size, and in fact, in which there is provided the possibility of making the combustion chamber elongated, even having sidewalls that are of linear configuration, wherein the combustion chamber may assume a rectangular shape, or a generally oval shape having side walls with substantial flattened or linear portions, yet still having such sidewall portions that have sub-segments that are sufficiently arcuately curved to withstand the forces of weight provided by the stoneware beds of the temperature recovery chambers, and preventing inward collapse of the walls separating the combustion chamber or chambers from the energy recovery chambers, all without requiring that these separating walls be unneccessarily thick.

OBJECTS OF THE INVENTION

Accordingly, it is a primary object of the above invention to provide a novel incineration apparatus capable of allowing a construction size for the incineration chamber that is substantially unlimited in its size or configuration.

It is further object of this invention to provide a heat exchange apparatus as set forth in the object above, wherein wall portions separating the combustion chamber from energy recovery chambers may be reasonable thin and constructed of refractory block even only a single refractory block thick, without the collapse of the block under the forces of heat-retention elements in the recovery chambers.

It is a further object of this invention to accompiish the above objects, wherein the use of an arcuate configuration for separation walls between the combustion and recovery chambers serves to minimize the thickness of such walls.

It is yet another object of this invention to accomplish the above objects, wherein such wall portions are constructed of substantially porous or perforated built-up block.

Other objects and advantages of the present invention will be readily apparent to those skilled in the art from a reading of the following brief descriptions of the drawings, detailed descriptions of the preferred embodiment, and the appended claims.

BRIEF DESCRIPTION OF THE DRAWING FIGURES

DETAILED DESCRIPTION OF THE PREFERRED EMBODIMENT

Figure 1:
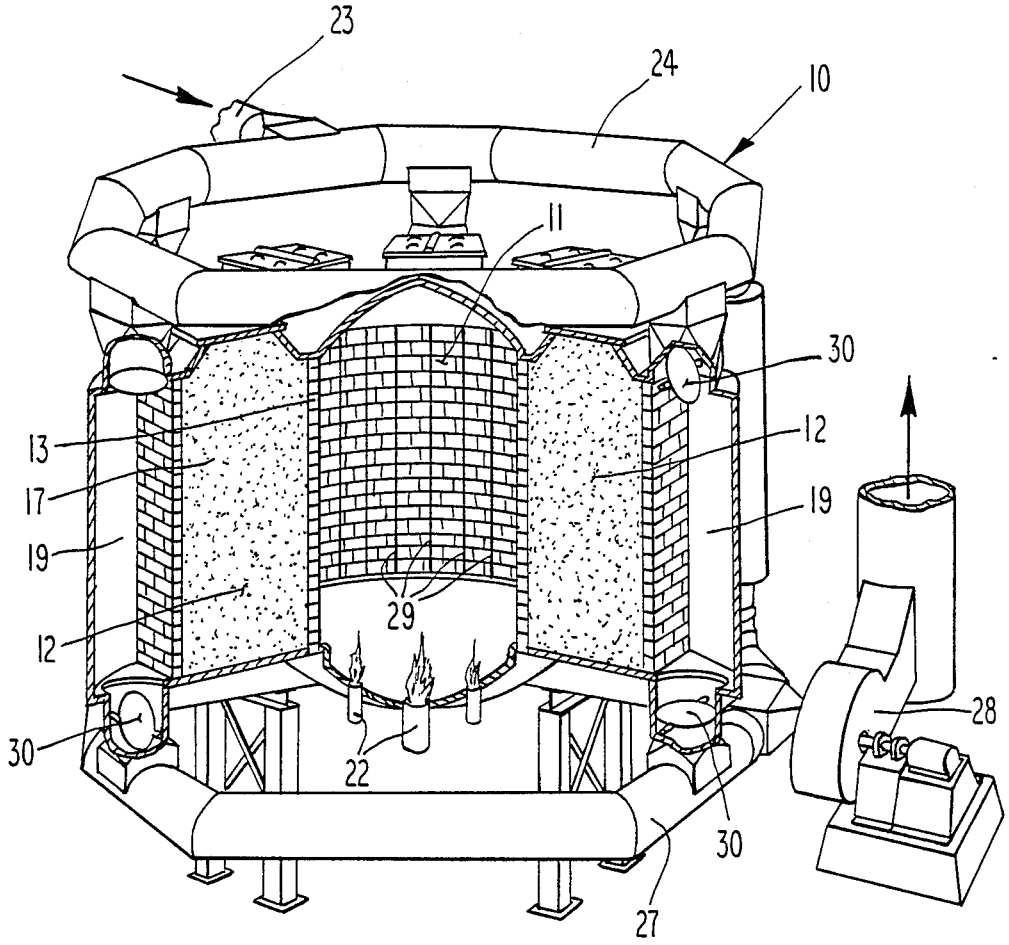
FIG. 1 is a schematic perspective view, partially broken away, of an incineration apparatus in accordance with the present invention.
Figure 2:
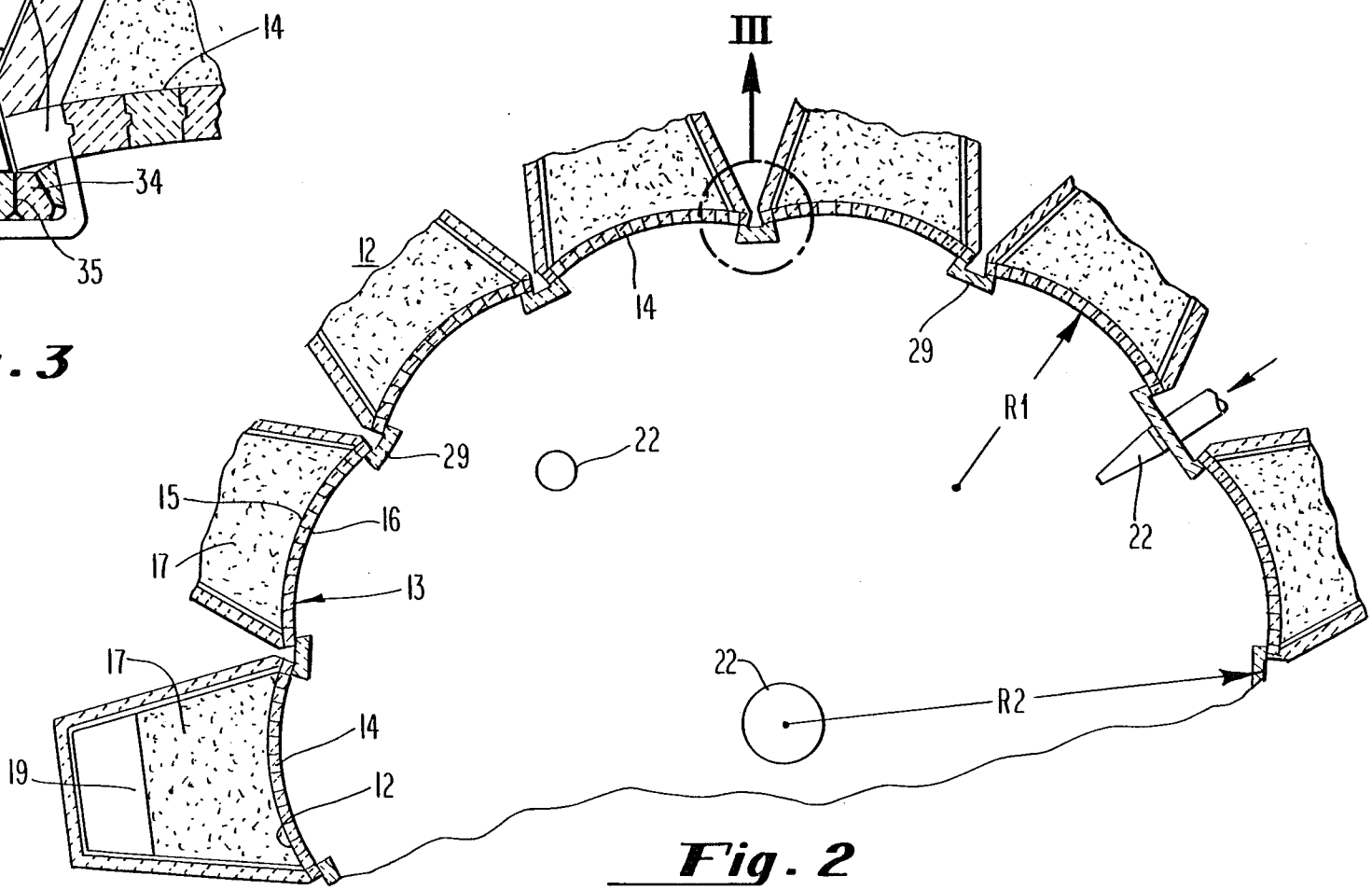
FIG. 2 is a schematic transverse sectional view in plan, of approximately half of the combustion chamber of FIG. 1, with portions of the contiguous energy recovery chambers illustrated therewith, but fragmentally so.

Referring now to the drawings in detail, reference is first made to FIG. 1, wherein an incineration apparatus is generally designated by the numeral 10, as comprising a high temperature combustion chamber 11 having a plurality of energy recovery chambers 12 disposed thereabout, separated therefrom by a wall 13. The chamber 11 is shown out of diametral scale (smaller) relative to the radial dimensions of the chamber 12, but correctly illustrates their relative positions. The wall 13 is shown in FIG. 2 to have convex sides or faces 15 and concave sides or faces 16. The stoneware 17 within the chambers 12 exert forces of weight or gravity against the convex faces 15 of the wall portions 14, that keep the individual blocks 18 (see FIG. 4), under compression. The blocks 18 have perforations 20 in them for passage of gases therethrough from concave faces 16 to convex faces 15, and the reverse, as will be explained hereinafter, and are generally constructed of refractory material, laid in generally horizontal rows, with each row comprising a plurality of blocks, and with adjacent rows being in staggered relation to each other, as the ends of the blocks illustrate in FIG. 4.

The combustion chamber 11 has a plurality of burners 22 therein, coming up through the bottom, and through different side wall portions of the wall 13, as illustrated in FIGS. 1 and 2. Such burners enable the combustion within the combustion chambers to take place at temperatures up to 2000° F., or more, depending upon the ingredients of the gases.

Generally, the incoming gases from a suitable factory, plant or the like enter the inlet 23, into the inlet toroid distribution facility 24, by which they may enter via vertical ducts 19, certain ones of the already-preheated energy recovery chambers 12, to pass over the pre-heated stones that are piece up therein, so that when such gases enter the combustion chamber by passing through the porous wall portions 14 thereof, into the combustion chamber 11, they may readily be burnt therein, with the gases then passing outwardly through other porous wall portions 14, passing through still other stoneware beds in recovery chambers 12, to serve to heat the stoneware within such chambers as they pass outwardly therethrough, on their way to a discharge duct 27, to be discharged via pump-operated duct 28, as shown, to atmosphere, preferrably in the form of carbon dioxide and moisture.

It will be seen that various valving arrangements 30 may be used to direct the flow of gases either inwardly through the recovery chambers on their way to combustion chamber 11, or outwardly from the combustion chamber 11, through the recovery chamber 12, as desired, but that, in any given apparatus 10, some of the recovery chambers 12, will, at any given time, be passing gases inwardly, and some will be passing gases outwardly, as will be understood from the prior art discussed above.

Figure 4:
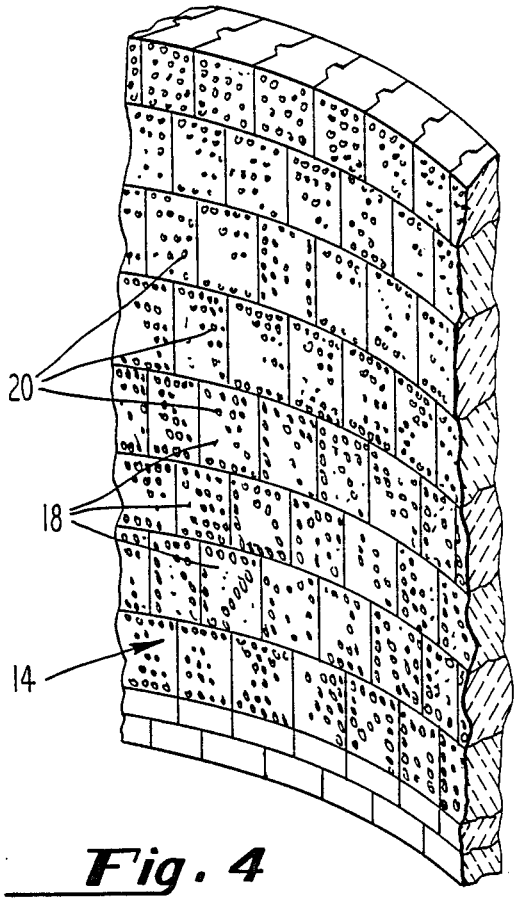
FIG. 4 is a fragmentary perspective view of a wall portion for separating the high temperature combustion chambers from the energy recovery chambers, in accordance with this invention.

With particular reference to FIG. 2, now, it will be understood that the wall portions 14 are constructed of blocks, as illustrated in FIG. 4, which blocks preferably have perforations 20, as shown, that pass from an inner or concave wall to an outer or convex wall, entirely through the block, and that the blocks are of the tongue-and-groove variety, as illustrated, such that adjacent blocks in a common row are in nested relation to each other, as illustrated, and that the wall portions 14 are each generally only of a single block in thickness.

It will also be apparent that the wall portions 14 terminate at the ends of their arcuate configurations, in an anchoring mechanism for absorbing the compressive forces applied by the stoneware disposed thereagainst.

Figure 3:
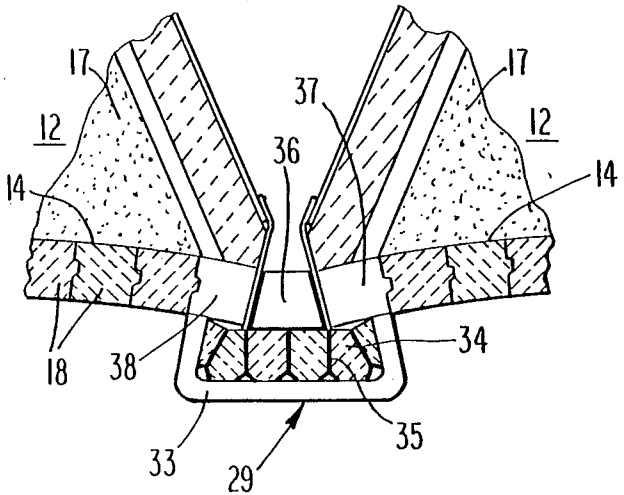
FIG. 3 is an enlarged, fragmentally illustrated schematic plan view in section, of the anchoring between adjacent curved or arcuate separating wall portions identified as detail III in FIG. 2 in accordance with this invention.

In this regard, reference is made to FIG. 3, in which one type of anchoring mechanism 29 is illustrated, as comprising a refractory face material 33, disposed against a gunned refractory material 34, which, in turn is provided with a plurality of steel anchors 35, that provide support, and with a suitable structural support 36 disposed between adjacent end blocks 37, 38, of adjacent arcuate wall portions 14, of adjacent recovery chambers 12.

It will further be apparent that any suitable anchoring mechanism or structure can be utilized, such as will meet the forces provided at the ends of the arcuate wall portions 14. For example suitable supports such as that 36, may, in themselves be sufficient, if constructed with sufficient structual integrity, such that the radially inwardly-imposing forces provided by the ends of the wall portions 14, would not drive such structural configurations 36 inwardly. For example, suitable retention means of any type for preventing the structural members 36 from moving radially inwardly may be provided, all within the spirit and scope of the invention.

With reference to FIG. 2, it will be seen that wall portions 14 are each of a radius R1 that is sufficiently less than the radius R2 of the wall 13 of the chamber 11, to provide the necessary arched configurations for wall portions 14 to withstand the forces imposed thereagainst by the weight of the stone elements against the convex faces thereof.

Figure 5:
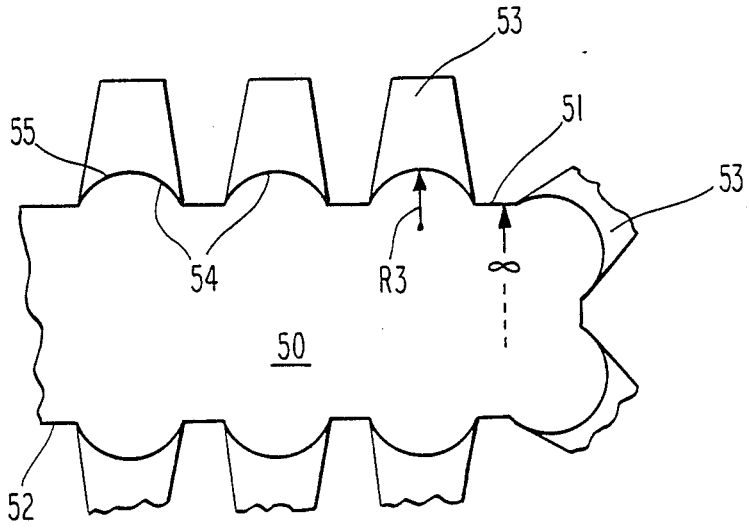
FIG. 5 is a schematic illustration of another configuration for a high temperature combustion chamber, in which there are two essentially linear legs to the chamber, connected by two arcuate ends, to comprise an essentially oval-configured combustion chamber having a plurality of energy recovery chambers disposed thereabout.

With reference to FIG. 5, it will be seen that the high temperature combusion chamber 50 may have a pair of substantially linear walls 51 and 52, each with recovery chambers 53 having arched porous wall portions 54, convex sides 55 of which have stoneware (not shown) disposed thereagainst.

The arrangement of FIG. 5 allows the construction of an incineration heat-exchange apparatus, of virtually any size or configuration, in that the essential configuration of side walls 51 of the incineration apparatus can be curved, or flat, as desired, but yet individual sub-sections, or wall portions 54, can be sufficiently arcuately curved that they can be thin (for example, of a single refractory block in thickness or thinness), but yet can, because of the curvature of such wall portions 54, be constructed to resist the gravity or weight-related forces of a pile of stoneware disposed thereagainst, against the convex portion thereof.

In view of the above, it is seen that an improvement exists in that the radius R3 of the arc of such wall portions 54 is less than the radius of the chamber wall 51, and that the radius of the arc of the chamber wall can be of any given radius, even up to infinity (as shown), in which case the wall will be substantially linear, but that still such radius of the arc of the separating wall portion will still be sufficient that the forces exerted by the heat retention elements against the convex sides of such wall portions will operate to keep the arcuate wall portions in compression. In accordance with the same, some anchoring means, such as that illustrated in FIG. 3, or an equivalent thereof, will be provided.

Preferably, the blocks 18 that make up the wall portions 14 are porous in the sense that they have perforations through them, which perforations amount to about 30%–40% of the volume of each said block.

As constructed, and in accordance with this invention, the apparatus will work such that contaminated fumes or odors may enter the apparatus through the inlet manifold-like ring 24. The valves 30 thus direct such gases containing fumes or the like, into the chambers 12, passing over the stoneware, and moving them toward the incineration chamber. They leave the stoneware beds 12 at temperatures very close to the incineration temperature. Oxidation is completed in the combustion chamber 11, by means of a gas (or oil) burner that maintains a pre-set incineration temperature.

The gases may contain volatile organic compounds that can autoignite, while still in the stoneware, and if they do, such will further reduce the auxiliary fuel reguirement provided by the burners 22. In some situations, the incoming gases entering the duct 23 may contain enough volatile organic compounds that the energy released can provide all of the heat required for the apparatus and the burner may automatically go to pilot. After the burning is effected in the chamber 11, the purified gases are then pulled from such chamber 11 through the stoneware beds which are at that time in an "outlet" mode, thereby passing heat to the stoneware, which the stoneware absorbs.

It will be understood that the situation is then reversed, such that a given stoneware bed alternately operates to receive heat from outgoing gases, or to pre-heat incoming gases, depending upon the settings of the valve 30.

In accordance with the present invention, gases may be treaeed from spray booths, for example, at an exhaust volume of 150,000 SCFM; agricultural pesticides may be disposed of at high rates of energy recovery; wide ranges of solvents from coating and laminating may be disposed of with a high percentage of thermal energy recovery; emissions from coatings of paper and film may be taken care of at high rates of energy recovery; hydrocarbons and ceramic kiln emissions may be disposed of at high rates of thermal energy recovery; and emissions from various chemical manufacturing processes may be disposed of, again at high rates of thermal energy recovery, as well as many other prospects of treatment in accordance with the present invention.

In accordance with the present invention, many other combinations of features may be employed, as well as many other uses and constructions of apparatus all employing the concepts of the present invention as defined in the appended claims.

What is claimed:

1. In a heat exchange apparatus having a high temperature combustion chamber for burning of gases therein, a plurality of energy recovery chambers disposed outside of but contiguous with said combustion chamber, and with said recovery chambers each containing a pile of heat retention elements therein, means for delivering gases to and from said combustion chamber via at least some of said recovery chambers, with said combustion chamber having a generally vertical wall comprising at least in part a plurality of common wall portions with said recovery chambers which separate said combustion chamber from associated said recovery chambers, with said common wall portions being sufficiently porous to allow passage of gases thereacross between said combustion chamber and associated said recovery chambers and being constructed of a plurality of refractory blocks, with said common wall portions comprising support wall means in part supporting a pile of heat retention elements thereagainst, with said wall portions being of generally arcuate configuration having convex sides facing said heat retention elements in said recovery chambers and having concave sides facing into said combustion chamber, wherein the improvement resides in the radius of the arc of at least some of said arcuately configured wall portions being less than the radius of the chamber wall and comprising means whereby forces exerted by the heat retention elements against said convex sides of said wall portions operate to keep said arcuate wall portions in compression, and including means anchoring ends of said arcuate wall portions against inward collapse from said forces.

2. The apparatus of claim 1, wherein said wall portions are comprised of blocks that have perforations therein.

3. The apparatus of claim 2, wherein each said wall portion has substantially uniform thickness and is comprised substantially solely from concave side to convex side by the thickness of a single block.

4. The apparatus of claim 2, wherein said perforations extend through their associated said blocks.

5. The apparatus of claim 2, wherein the perforations comprise passageways that comprise about 30%–40% of the volume of each said block. comprised of blocks that have perforations therein.

6. The apparatus of claim 1, wherein said wall portions are constructed of a plurality of rows of blocks, with each row comprised of a plurality of blocks.

7. The apparatus of claim 6, wherein said rows are each generally horizontal.

8. The apparatus of claim 7, wherein adjacent rows of blocks are in staggered relation to each other.

9. The apparatus according to any one of claims 1–6, or 7-5, wherein the wall of the high temperature combustion chamber is of generally circular configuration.

10. The apparatus of any one of claims 1–6 or 7-5, wherein the wall of the high temperature combustion chamber includes at least one substantially linear leg having at least one said arcuate wall portion therein.

11. In a heat exchange apparatus having a combustion chamber, and at least one contiguous chamber, and with said contiguous chamber containing a pile of weight-producing elements therein, means for delivering gases to and from said combustion chamber via said contiguous chamber, with said combustion chamber having a wall comprising at least in part a generally vertical common wall portion with said contiguous chamber which separates said combustion chamber from said contiguous chamber, with said common wall portion being sufficiently porous to allow passage of gases thereacross and being constructed of a plurality of refractory blocks, with said common wall portion comprising support wall means in part supporting said weight-producing elements thereagainst, with said wall portion being of generally arcuate configuration having a convex side facing said elements in said contiguous chamber and having a concave side facing into said combustion chamber, wherein the improvement resides in the radius of the arc of said arcuately configured wall portion being less than the radius of the chamber wall and comprising means whereby forces exerted by the elements against said convex side of said wall portion operates to keep said arcuate wall portion in compression, and means anchoring ends of said arcuate wall portion against inward collapse from said forces.

12. In a heat exchange apparatus having a high temperature combustion chamber for burning of gases therein, a plurality of energy recovery chambers disposed outside of but contiguous with said combustion chamber, and with said recovery chambers each containing a pile of heat retention elements therein, means for delivering gases to and from said combustion chamber via at least some of said recovery chambers, with said combustion chamber having a wall comprising at least in part a plurality of common generally vertical wall portions with said recovery chambers which separate said combustion chamber from associated said recovery chambers, with said common wall portions being sufficiently porous to allow passage of gases there across between said combustion chamber and associated said recovery chambers and being constructed of a plurality of rows or blocks, with each row comprising a plurality of refractory blocks, the blocks having tongue portions and groove portions in opposite ends thereof, and with adjacent blocks in a given row being nested end-to-end in tongue-and-groove relation to each other, with said common wall portions comprising support wall means in part supporting a pile of heat retention elements there against, with said wall portions being of generally arcuate configuration having convex sides facing said heat retention elements in said recovery chambers and having concave sides facing into said combustion chamber, wherein the improvement resides in the radius of the arc of at least some of said arcuately configured wall portions being less than the radius of the chamber wall and comprising means whereby forces exerted by the heat retention elements against the covex sides of said wall portions operate to keep said arcuate wall portions in compression, and including means anchoring ends of said arcuate wall portions against inward collapse from said forces.

13. The apparatus of claim 12 wherein said wall portions are comprised of blocks having perforations therein.

14. The apparatus of claim 13 wherein said rows of blocks are each generally horizontal, wherein adjacent rows of blocks are in staggered relation to each other, and wherein each said wall portion has substantially uniform thickness and is comprised of substantially solely from concave sides to convex sides by the thickness of a single block.

15. The apparatus of according to any one of claims 12–14, wherein the wall of the high temperature combustion chamber is of a generally circular configuration.

16. The apparatus of any one of claims 12–14, wherein the wall of the high temperature combustion chamber includes at least one substantially linear leg having at least one said arcuate wall portion therein.

* * * * *

UNITED STATES PATENT OFFICE

CERTIFICATE OF CORRECTION

Patent No. 4,779,548 Dated October 25, 1988

Inventor(s) James H. Mueller and Rodney L. Pennington

It is certified that error appears in the above-identified patent and that said Letters Patent is hereby corrected as shown below:

In Claim 5, line 3, after the words "said block." delete --comprised of blocks that have perforations therein.--

In Claim 9, lines 1 and 2, after the word "claims" delete --1-6 or 7-5-- and insert therefore "1-8".

In Claim 10, line 1 after the word "claims" delete -- 1-6 or 7-5-- and insert therefore "1-8".

In Claim 11, line 6, after the words "having a" insert the words "generally vertical" and on line 7, after the words "in part a" delete the words --generally vertical--.

Signed and Sealed this

Twenty-seventh Day of February, 1990

*Attest:*

JEFFREY M. SAMUELS

*Attesting Officer* *Acting Commissioner of Patents and Trademarks*